United States Patent [19]

Chandler

[11] 4,318,342

[45] Mar. 9, 1982

[54] AMMUNITION WITH SURFACE-MOUNTED LIGHT-SETTABLE PICKUP ARRANGEMENT FOR DIGITAL MEMORY STORAGE

[75] Inventor: Charles E. Chandler, Baltimore, Md.

[73] Assignee: AAI Corporation, Cockeysville, Md.

[21] Appl. No.: 115,587

[22] Filed: Jan. 25, 1980

[51] Int. Cl.[3] ..... F42C 17/00

[52] U.S. Cl. ..... 102/207; 89/6.5; 102/201

[58] Field of Search ..... 102/201, 207; 89/6, 89/6.5

[56] References Cited

U.S. PATENT DOCUMENTS 3,228,337 1/1966 Grantham et al. ..... 102/201
3,500,746 3/1970 Ambrosini ..... 89/6.5
4,091,734 5/1978 Redmond et al. ..... 102/207

*Primary Examiner*—Charles T. Jordan
*Attorney, Agent, or Firm*—Reginald F. Pippin, Jr.

[57] ABSTRACT

A projectile having a light-settable photodetector pickup assembly, in the form of a plurality of photovoltaic cell units, circumferentially mounted on the annular surface of the projectile, and also having an angular-position-indicating index reflector on the surface thereof. Each discrete photovoltaic cell unit is electrically connected with an electrical signal storage unit which is activated as a function of light acting on the respective photovoltaic cell unit associated therewith. A further photovoltaic cell unit is preferably provided as a source of energy for storage unit and/or logic or other circuit of operation.

22 Claims, 3 Drawing Figures

AMMUNITION WITH SURFACE-MOUNTED LIGHT-SETTABLE PICKUP ARRANGEMENT FOR DIGITAL MEMORY STORAGE

This invention relates to ammunition in which data is desired to be inputted, such as for actuating a fuze at a selected time interval after firing and launch of the projectile.

Various methods have been employed for inputting data to a projectile, such as for setting a fuze timer, including the use of various mechanically set devices on the projectile body. Such mechanically set data input arrangements require an amount of time for setting of data therein which is incompatible with high rate of fire weapons.

It is an object of this invention to provide a projectile data input arrangement which enables rapid and accurate setting of data into the projectile and/or a projectile fuze without necessitating contact between the data input arrangement and the projectile.

A further object is the provision of a digital data inputting arrangement for a projectile and/or a fuze in which the data is inputted by utilizing a digital light input.

A still further feature of the invention is the provision of a digital data inputting arrangement for a projectile and/or a fuze, in which the data is inputted by a digital light input to a multiple light sensor arrangement on the annular exterior of the projectile and/or fuze.

Still another feature is the provision of light energy transfer means for enabling circuit operating energy to be transferred into an operable circuit in a projectile and/or fuze so as to minimize or obviate the necessity for on-board electrical power.

Still other objects, features and attendant advantages will become apparent from a reading of the following detailed description of a preferred embodiment of the invention, taken in conjunction with the accompanying drawings, wherein.

Figure 1:
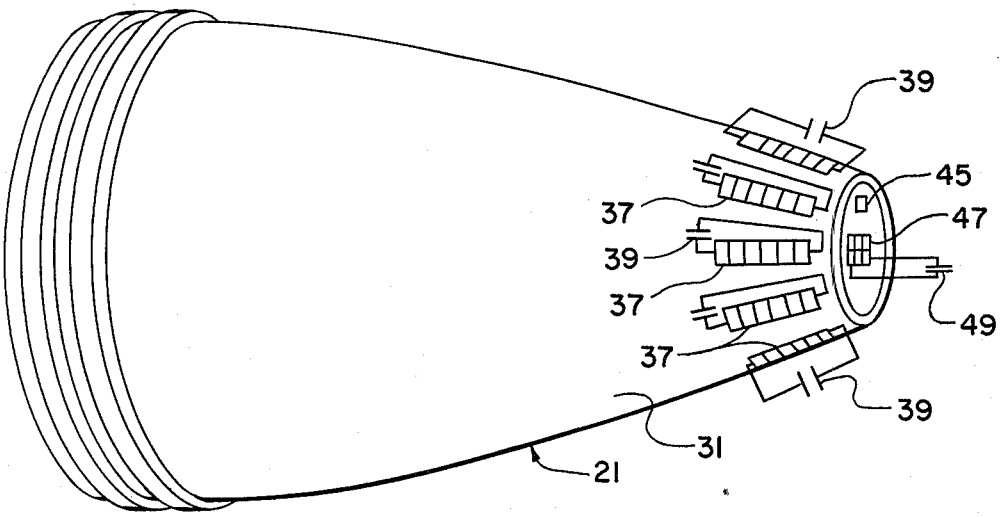
FIG. 1 is a schematic representation of a projectile/-fuze arrangement according to the invention.
Figure 2:
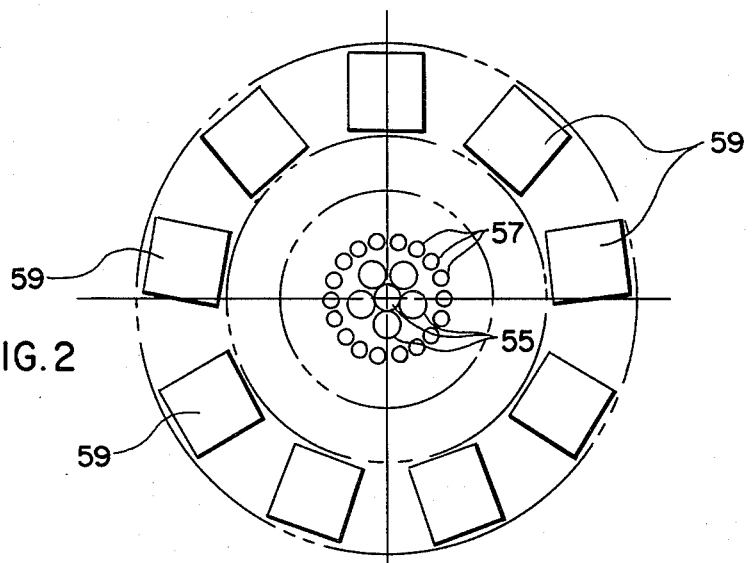
FIG. 2 is a schematic illustration in plan view of the light data input setting unit, shown looking into the setting end thereof.
Figure 3:
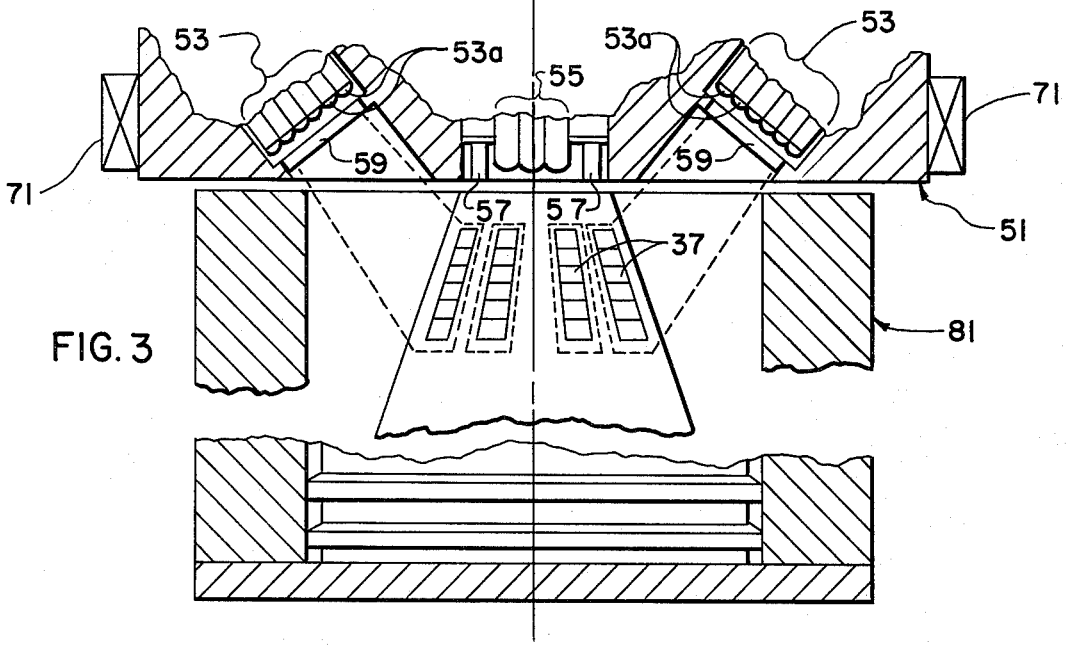
FIG. 3 is a schematic view of the projectile of FIG. 1 in conjunction with a setting arrangement for inputting data thereto, the setting arrangement being shown in section for clarity of illustration.

Referring now in detail to the Figures of the drawing, a projectile 21 having a time-settable fuze 31 is provided with a light-settable digital data input arrangement in the form of a plurality of discrete sensors 37, each formed by one or an inter-connected unit group of photovoltaic cells. The photovoltaic cells 37 form the input and transfer portion of a data transfer and storage arrangement, with storage being effected by an accompanying respective individual charge storage capacitor 39 connected across each respective individual discrete cell or group of connected cells 37. The storage capacitors 39 and/or any other data storage elements and associated data use circuitry, such as timing circuitry, may be suitably located at any desired zone within the projectile and/or fuze 21, 31.

Capacitors 39 are only required to hold their charge for a relatively short length of time, as for instance less than one second, as the data input can be accomplished immediately preceding or during the loading of the round of ammunition into a weapon for firing, with firing being accomplished substantially immediately thereafter. Such short storage times can readily be effected with conventional capacitors. If longer periods are required a more long term storage medium, such as a flip-flop, may be used or added for each storage element required.

The storage capacitors 39 may be located at any desired location on or in the projectile/fuze 21, 31, and as will be readily apparent to one skilled in the digital electronics art, the capacitors 39 may be connected to any desired electrical timing or other desired user circuit (not shown) which is desired to be employed for actuating the fuze or some other portion of the projectile, as for instance at a subsequent selected time period after firing which selected time period correponds to the digital input to, and stored as a composite digital signal on the capacitors 39 through passing of a burst or sequence of light onto selected ones of the photovoltaic cells 37 corresponding to the particular digital or other value desired to be inputted and stored.

The necessary light input to the selected photovoltaic cells 37 for any selected composite digital signal may be effected through employment of a setting arrangement including an input data setting head 51 which has a plurality of selectively actuatable light sources 53, each disposed in alignable position with a corresponding one of the exterior photovoltaic cells 37.

Cylindrical or other suitable lenses 59 may be employed in association with light sources 53 for directing the light from the light sources 53 onto and across the width full area of the respective photovoltaic cells 37. While various light sources may be employed, a presently preferred form of individual light source 53 is shown as a bank of LED lamps 53*a*. The resultant beam of light as directed against the annular surface of the projectile/fuze 21, 31 may thus suitably take a generally rectangular or trapezoidal form, such that the beam of light from each respective light source/lens 53, 59, will occupy a discrete angular extent on the surface of projectile/fuze 21/31, and preferably closely adjacent the two beams on either side thereof when the projectile/-fuze 21, 31 is fully inserted in setting position within the bore of positioning unit 81 therefor. A radially offset indexing mirror or other reflector 45 is provided on the end of projectile/fuze 21, 31, to enable alignment of the light sources 53 with photovoltaic cells 37.

Upon seated random angular positioning of the projectile/fuze 21, 31 within the positioning unit, light from a generally central indexing light source 55 will be reflected from indexing mirror 45 onto one, or two adjacent ones, of a plurality of circumferentially closely arranged angular position detecting photocells 57 in the input data setting head 51. The position detecting photocells 57 may be connected with suitable logic circuitry (not shown) which may provide an output correction signal for enabling rotational movement of the data input setting head 51 or the projectile/fuze 21, 31, preferably the setting head 51, by an amount to bring the individual beams of light from each individual one of the light sources/lenses 53, 59, into registry with only a single respective photovoltaic cell or group of cells 37 on the surface of projectile/fuze 21, 31. The final detected reflection from index reflector 45 onto a respective angular position detector photocell will enable the desired digital input data for each respective photovoltaic cell or group of cells 37 to be inputted through the respective correct individual light source/lens 53, 59.

The particular logic and control circuitry and angular movement effecting means may be ordinary circuitry and motion-imparting means commonly available to and derivable by those skilled in the art, and is not described or shown as such does not itself form a part of this invention.

It will be apparent from the foregoing that it will only be necessary to effect rotational aligning movement of the setting head 51 when the light beams overlap onto two adjacent photovoltaic cells 37. Otherwise, no movement is required; and as the light beam areas on the projectile/fuze surface are preferably substantially wider than the width of the photovoltaic cells 37, this overlap condition will be infrequent from a statistical standpoint.

As an aid to ease of angular movement of the setting head 51, this head 51 may be suitably mounted in a journal or bearing 71.

The projectile is preferably also provided at its forward end with a central photovoltaic cell or group of cells 47 and associated electrical power storage unit 49, which may take the form of a suitable storage capacitor, for enabling the transfer of power source energy to the utilization circuitry (not shown), such as a timing and fuze actuating circuit, which utilizes or operates from the digital data inputted to and stored on storage capacitors 39. This will enable the data stored in projectile/-fuze 21, 31, to be utilized by a utilization circuit without necessity for an on-board battery source, which can be of substantial importance in reducing likelihood of explosions. The central indexing light source 55 may suitably be, and is preferably, utilized in the dual capacity of a power light source for photovoltaic cells 47, by making such of sufficient intensity to effect the desired power transfer to cells 47. This is particularly advantageous in that the preferred location of the light source for both the indexing and power transfer functions is axial and adjacent the forward or nose end of the projectile/fuze 21, 31.

As an aid to prevention of inputting of false data to the projectile/fuze storage media through photocells 37, photovoltaic cells may be employed which are sensitive to selected bandwidths of light, such as the near IR, or ultraviolet, and the user circuit may have a threshold signal storage transfer which requires a high level light input to the photovoltaic cells 37 to effect a usable signal on capacitors 39. While an eight bit input and storage arrangement is shown, it will be apparent that any desired number of bits may be employed within the physical limits of the arrangement.

While the invention has been illustrated and described with respect to a single physical embodiment, it will be apparent that various modifications and improvements may be made without departing from the scope and spirit of the invention. Accordingly, the invention is not to be limited by the specific illustrative embodiment, but only by the scope of the appended claims.

I claim:

1. A projectile having a light-settable photodetector and signal storage arrangement, comprising, a projectile body section having a plurality of discrete photovoltaic cell units disposed in spaced relation about the annular periphery of said body section, and a discrete electrical storage medium connected to each of said photovoltaic cell units for compositely registering a composite digital signal transmitted by light through said passageways to said photovoltaic cells.

2. A projectile according to claim 1, and indexing means on said projectile for index location of said photovoltaic cell units with an external source of data input light.

3. A projectile according to claim 2, said indexing means comprising a light reflector.

4. A projectile according to claim 3, said light reflector being disposed at a selected angular location on said projectile body.

5. A projectile according to claim 4, said light reflector being disposed at the forward nose end of said projectile and having a reflecting portion thereof radially offcenter of the projectile nose end.

6. A projectile according to claim 1, said discrete electrical storage medium for each said photovoltaic cell unit comprising a respective storage capacitor connected thereto.

7. A projectile according to claim 6, said discrete electrical storage medium for each said photovoltaic cell unit further comprising a digital memory unit.

8. A projectile according to claim 1, and a further photovoltaic cell power unit disposed on the forward end surface of said projectile for receiving and translating external light energy into a storable electrical power charge, and a storage capacitor connected in power storing relation to said further photovoltaic cell power unit.

9. A projectile according to claim 2, and a further photovoltaic cell power unit disposed on the forward end surface of said projectile for receiving and translating external light energy into a storable electrical power charge, and a storage capacitor connected in power storing relation to said further photovoltaic cell power unit.

10. The combination of a projectile according to claim 2, and a rotatable light signal setting head, said setting head comprising, a body having a plurality of light passageways corresponding to the photovoltaic cell units of said projectile and alignable therewith, indexing means for alignment of said setting head light passageways with said projectile photovoltaic cell units, and selectively individually actuatable light source means for each of said setting head light passageways.

11. The combination according to claim 10, said indexing means comprising, a reflector disposed at a selected angular location on said projectile body, an indexing light source on said setting head for directing light onto said reflector, and light reflection detection means on said setting head for sensing the angular location of said indexing reflector means as a function of the angular position of the reflected light therefrom.

12. The combination according to claim 11, and a further photovoltaic cell power unit disposed on the forward end surface of said projectile for receiving and translating external light energy into a storable electrical power charge, and a storage capacitor connected in power storing relation to said further photovoltaic cell power unit, and a power light source on said setting head for directing power transfer energy to said further photovoltaic power cell unit.

13. The combination according to claim 12, and said power light source being also said indexing light source.

14. A fuze having a light-settable photodetector and signal storage arrangement, comprising, a projectile body section having a plurality of discrete photovoltaic cell units disposed in spaced relation about the annular periphery of said body section, and a discrete electrical storage medium connected to each of said photovoltaic cell units for compositely registering a composite digital signal transmitted by light through said passgeways to said photovoltaic cells.

15. A fuze according to claim 14, and indexing means on said fuze for index location of said photovoltaic cell units with an external source of data input light.

16. A fuze according to claim 15, said indexing means comprising a light reflector.

17. A fuze according to claim 16, said light reflector being disposed at a selected angular location on said fuze body.

18. A fuze according to claim 17, said reflector being disposed at the forward nose end of said fuze and having a reflecting portion thereof radially offcenter of the fuze nose end.

19. A fuze according to claim 14, said discrete electrical storage medium for each said photovoltaic cell unit comprising a respective storage capacitor connected thereto.

20. A fuze according to claim 14, said discrete electrical storage medium for each said photovoltaic cell unit comprising a digital memory unit.

21. A fuze according to claim 14, and a further photovoltaic cell power unit disposed on the forward end surface of said fuze for receiving and translating external light energy into a storable electrical power charge, and a storage capacitor connected in power storing relation to said further photovoltaic cell power unit.

22. A fuze according to claim 15, and a further photovoltaic cell power unit disposed on the forward end surface of said fuze for receiving and translating external light energy into a storable electrical power charge, and a storage capacitor connected in power storing relation to said further photovoltaic cell power unit.

* * * * *